US011506091B2

(12) United States Patent
Kipnis

(10) Patent No.: US 11,506,091 B2
(45) Date of Patent: Nov. 22, 2022

(54) POPPET VALVE AND INTERNAL COMBUSTION PISTON ENGINE HEAD INCLUDING SAME

(71) Applicant: Cyclazoom, LLC, Skokie, IL (US)

(72) Inventor: Michael Kipnis, Skokie, IL (US)

(73) Assignee: Cyclazoom, LLC, Skokie, IL (US)

( * ) Notice: Subject to any disclaimer, the term of this patent is extended or adjusted under 35 U.S.C. 154(b) by 0 days.

(21) Appl. No.: 17/650,118

(22) Filed: Feb. 7, 2022

(65) Prior Publication Data

US 2022/0282645 A1 Sep. 8, 2022

Related U.S. Application Data

(60) Provisional application No. 63/155,812, filed on Mar. 3, 2021.

(51) Int. Cl.
*F01L 3/20* (2006.01)
*F01L 3/08* (2006.01)
*F01L 3/22* (2006.01)

(52) U.S. Cl.
CPC *F01L 3/20* (2013.01); *F01L 3/08* (2013.01); *F01L 3/22* (2013.01)

(58) Field of Classification Search
CPC ..... F01L 3/22; F01L 3/08; F01L 3/20
See application file for complete search history.

(56) References Cited

U.S. PATENT DOCUMENTS 821,758 A 5/1906 Smith
1,539,167 A 5/1925 Diel et al.
1,969,202 A 8/1934 Bugaud
3,757,757 A 9/1973 Bastenhof
3,861,376 A 1/1975 Ashley
3,871,339 A 3/1975 Kuhn
4,424,777 A 1/1984 Klomp
4,428,336 A 1/1984 Dye et al.
4,744,340 A 5/1988 Kirby
4,976,248 A 12/1990 Rowe
4,981,118 A 1/1991 Lefebvre
5,099,808 A 3/1992 Matsuura et al.
(Continued)

OTHER PUBLICATIONS

International Search Report for PCT/US20/26125 dated Jun. 30, 2020.
Written Opinion for PCT/US20/26125 dated Jun. 30, 2020.

*Primary Examiner* — Kevin A Lathers
(74) *Attorney, Agent, or Firm* — Brian Roffe

(57) ABSTRACT

Internal combustion piston engine includes a cylinder head partly defining two ducts and a combustion chamber, and poppet valves movably arranged in the cylinder head between positions allowing or preventing flow between the combustion chamber and the ducts. The poppet valve has a stem, a valve head having a hollow interior space, a lower surface facing the combustion chamber, an upper surface including a portion adjacent the stem, and a peripheral edge section that extends from the upper surface of the valve head to the lower surface. The valve head is formed separate from but connected to the valve stem in a manner to enclose the hollow space, for example, by a circumferential welding seam. The peripheral edge section contains an arcuate contact surface that extends from the upper to lower surfaces of the valve head and without any sharp edges between upper and lower surfaces.

20 Claims, 5 Drawing Sheets

(56) References Cited

U.S. PATENT DOCUMENTS

| | | | | |
|---|---|---|---|---|
| 5,168,843 | A | 12/1992 | Franks | |
| 5,301,640 | A | 4/1994 | Barranco, Jr. | |
| 5,485,815 | A | 1/1996 | Shida | |
| 5,619,796 | A | 4/1997 | Larson et al. | |
| 5,771,852 | A | 6/1998 | Heimann, Jr. et al. | |
| 6,679,478 | B2 | 1/2004 | Murayama | |
| 7,182,056 | B1 | 2/2007 | Czysz | |
| 7,377,249 | B1 | 5/2008 | Dingle | |
| 8,230,834 | B2 | 7/2012 | Endo | |
| 9,995,187 | B2 | 12/2018 | Davis | |
| 10,787,939 | B1 | 9/2020 | Kipnis | |
| 2006/0180115 | A1 | 8/2006 | Rubert | |
| 2007/0266984 | A1 | 11/2007 | Reinhardt et al. | |
| 2009/0095247 | A1 | 4/2009 | Cheng | |
| 2009/0266314 | A1* | 10/2009 | Uchiyama | F01L 3/02 29/888.45 |
| 2013/0199489 | A1* | 8/2013 | Endrigo | F02F 1/4264 123/193.3 |
| 2013/0333667 | A1 | 12/2013 | Ishida et al. | |
| 2016/0348546 | A1 | 12/2016 | Kurahashi et al. | |
| 2017/0211433 | A1 | 7/2017 | Davis | |
| 2017/0276032 | A1* | 9/2017 | Murakami | F01L 3/02 |
| 2019/0076480 | A1* | 3/2019 | Hare | A61P 9/00 |

* cited by examiner

POPPET VALVE AND INTERNAL COMBUSTION PISTON ENGINE HEAD INCLUDING SAME

CROSS REFERENCE TO RELATED APPLICATION

This application claims priority of U.S. provisional patent application Ser. No. 63/155,812 filed Mar. 3, 2021, which is incorporated by reference herein.

FIELD OF THE INVENTION

This invention relates generally to internal combustion piston engine heads, and more specifically to poppet valves for such.

BACKGROUND OF THE INVENTION

Internal combustion piston engine heads use poppet valves to control the intake and exhaust of gases as the engines operate. Most internal combustion engines are of the four-stroke variety, and four-stroke engines use only poppet valves (disregarding Vankel engines where there is no valve). Such an engine includes a head which forms the upper surface of the combustion chamber. The intake and exhaust valves open and close to permit or restrict gas flow through their respective intake and exhaust openings in the head. It is generally recognized as highly desirable to improve the engine's ability to "breathe". An engine is essentially a gas pump which pumps in air-fuel mixture and pumps out waste gas or exhaust. Because the exhaust gas is typically under significantly greater pressure than the air-fuel mixture, most engine designs use intake valves which are larger than their exhaust valves. However, smaller exhaust valves create more back pressure on a piston.

A typical prior art poppet valve includes an elongated, cylindrical stem coupled to (and typically integrally formed with) a poppet. The poppet is sometimes referred to as the disc of the valve. The poppet is typically adapted with a seating face which is angled to mate with a corresponding surface in the head (not shown) known as the valve seat. The widest part of the poppet limits the size of the valve and the lift, as the valve must not be permitted to strike or interfere with any other engine component. The poppet valve typically has a flat lower surface. By flat, it is meant planar in that the surface may be considered entirely resident in a single plane.

Modern four-stroke engines use overhead camshafts to open their valves, and valve springs to return the valves to their closed position. In most instances, the valves and their actuating hardware such as shims, buckets, cam followers, and so forth, are designed to permit—and in many cases encourage—the valves to gradually rotate within their valve seats. This improves the evenness of valve wear, and helps prevent loss of compression due to localized carbon buildup and the like. Therefore, valves are constructed as an axi-symmetric revolve, meaning that they are symmetrical about the axis of their shaft. This symmetry also improves manufacturability and lowers manufacturing cost.

However, a conventional poppet valve which is used in a four-stroke engine head has sharp edges which makes the flow around the poppet valve not smooth and for high velocity flow, the lack of smoothness causes turbulence and shock waves and therefore restricts flow. This translates into lower engine-fuel efficiency and higher emission. It also creates significant noise and needs a powerful muffler which increased back-pressure on the piston.

Prior art of interest to the field of the invention includes:

U.S. Pat. No. 4,981,118 (Lefebvre) which describes an internal combustion engine having one or more cylinder assemblies containing pistons, for driving the pistons by an air-fuel mixture introduced into the one or more cylinder assemblies through one or more pairs of valve apertures for combustion and for expelling the combusted air fuel mixture from the cylinder assembly through the pairs of valve apertures. Each pair of valve apertures has a movable poppet valve defining a head and at least two stems endwisely attached to the head spacedly parallel to each other. At least one pair of valve apertures and at least one poppet valve head has a non-circular peripheral contour. Valve stem guide means, one for each valve stem, guide displacement thereof exactly axially thereof. Each valve is positively prevented from rotating at all times. Upon the valve head thereof closing the corresponding valve port aperture, the valve head thereof positively seals at all times this valve port aperture.

U.S. Pat. No. 5,168,843 (Franks) describes a poppet valve having a valve body including first and second opposed faces and an internal port extending therebetween. A superior portion for positioning the valve body is connected to the first face, which includes first and second annular sealing surfaces. The first sealing surface is coaxial with the second sealing surface and tapers toward the superior portion. The second sealing surface surrounds an opening of the internal port and tapers toward the second face. A cylinder head design for an internal combustion engine is likewise disclosed which provides annular seats with which the first and second sealing surfaces cooperate to selectively open or close the valve.

U.S. Pat. No. 5,301,640 (Barranco, Jr.) describes an engine valve including a valve stem having a valve head fixedly and orthogonally mounted to the valve stem. The valve head includes a valve head bottom wall and a valve head helical top wall, the top wall being arranged concentrically about the valve stem. The valve head further includes a conical side wall portion, with the top wall including a top wall first end in contiguous communication with the conical side wall portion, and a top wall second end radially directed and in intersection with the valve stem, with the top wall second end arranged in a spaced relationship relative to the conical side wall portion.

U.S. Pat. No. 5,771,852 (Heimann, Jr. et al.) describes a poppet valve having a disk-shaped head, an elongated stem and a tapered neck between the head and the stem. The neck has an outer surface with an undulating circumferential contour. The undulating circumferential contour at the neck is defined by an embossed hollow wall portion of the valve and a plurality of grooves at the outer surface of the neck. Alternatively, the undulating circumferential contour is defined by a plurality of ribs at the outer surface of the neck. In each case, the undulating circumferential contour improves component strength and heat transfer efficiency. The undulating circumferential contour may also influence valve rotation and inlet charge swirl.

U.S. Pat. No. 6,679,478 (Murayama) describes a hollow poppet valve having a fillet area opened like a flare, which is formed at one end of a cylindrical stem portion, and a cap integrated by welding at the opened edge portion of the fillet area, is provided such that the opened edge portion of the fillet area is formed to be thicker than the other areas, and a face is formed at the thicker portion. The open edge portion at which a cap is welded is thicker than the other areas to reduce the influence of the heat of welding on the face. By making the open edge portion of the fillet area thicker, adverse metallurgical influences due to welding heat on the face can be evaded, whereby the face can be maintained at a desired hardness. By making the other areas of the valve which are not significantly influenced by the heat of welding thinner, the total weight of the valve can be reduced.

U.S. Pat. No. 7,182,056 (Czysz) describes a poppet valve for use in an internal combustion engine. The poppet has a partially-inverted perimeter shape which substantially maintains the curtain area of the valve, and enables the valves to be packed more efficiently into the combustion chamber roof area than conventional, circular-perimeter poppet valves. For the same size combustion chamber, significantly greater total curtain area is thus achieved, improving engine performance. Valve weight is greatly reduced, enabling the use of lighter return springs, camshafts, desmodromic actuators, and so forth.

U.S. Pat. No. 8,230,834 (Endo) describes a hollow poppet valve having a stem portion provided at one end thereof with a tip portion, a cap portion, and a flared fillet portion formed between the stem portion and the cap portion. At least part of the stem portion that connects to the fillet portion is a thin hollow cylindrical member, and the cap member is welded to the fillet portion. The cap member is thin and has an arcuate axial cross section. It is laser-beam welded to the seat-abutment portion formed at the open end of the fillet portion such that a weld bead is formed along the inner periphery of the interface of the mated ends of the members. The weld bead adds an extra weld depth to the weld, which increases the modulus of section of the welded regions of the cap member and the fillet portion and enhances their welding strength.

U.S. Pat. Appln. Publ. No. 20090266314 (Uchiyama et al.) describes a coolant-containing hollow poppet valve which, in use, in consideration of a temperature distribution caused in each part of the valve, causes a lowering in fatigue strength and creep strength in the valve at its site exposed to high temperatures falling within the tolerance of design standard, and, in consideration of required properties at the other valve sites, holds abrasion resistance and strength, and a process for producing the same. An improvement in heat resistance, abrasion resistance and strength depending upon properties required in each site is realized by conducting a cold drawing step and an intermediate annealing step to bring the Vickers hardnesses of a cylindrical shaft portion and a fillet-shaped head portion open in a flare form to the other end of the shaft portion to approximately not less than 250 Hv and not more than 350 Hv, and approximately not less than 350 Hv, respectively, and conducting cold pressing to bring the Vickers hardness of a seat portion in the outer periphery of the opening to not less than 380 Hv.

U.S. Pat. Appln. Publ. No. 20160348546 (Kurahashi et al.) describes a poppet valve including a head portion formed integrally with one end side of a stem portion, wherein, on the head portion, a heat insulating portion that is positioned on a combustion chamber side and a metal layer that is positioned on a stem portion side and insulates radiation heat are formed. A hollow portion extending along a head surface is formed in the head portion, a metal layer that insulates radiation heat is formed on an upper end surface of the hollow portion, and a heat insulating portion is formed between the metal layer and a bottom surface of the hollow portion. Also, a metal layer that insulates radiation heat is formed on a bottom surface of the head portion, and a heat-insulating surface treatment layer is formed on a combustion chamber side of the metal layer that insulates radiation heat.

U.S. Pat. No. 10,787,939 (Kipnis) describes an internal combustion piston engine including a cylinder head and a poppet valve movably arranged in the cylinder head and having a stem, a valve head having upper and lower surfaces and a peripheral edge section between the upper and lower surfaces. The peripheral edge section contains an arcuate contact surface without any straight edges between the upper surface of the valve head and the lower surface of the valve head. The valve head does not include sharp elements, e.g., an element formed between two straight or flat portions that has an obtuse angle or an acute angle therebetween. In one embodiment, the cylinder head has a valve seat that has an arcuate contact surface that matches the arcuate contact surface of the peripheral edge section. The valve seat also does not include sharp elements. The cylinder head may include a duct that does not have sharp edges thereby providing a smooth operative flow through the duct.

SUMMARY OF THE INVENTION

A poppet valve for an internal combustion piston engine, or other type of engine, in accordance with the invention includes a stem, a valve head having a lower surface and an upper surface opposite the lower surface and including a portion adjacent the stem, and a peripheral edge section that extends from the upper surface of the valve head to the lower surface of the valve head. The peripheral edge section is curved entirely from the upper surface of the valve head to the lower surface of the valve head, which itself is curved outward in a direction away from said stem over its entirety, i.e., convex. The peripheral edge section and lower surface of the valve head preferably do not include sharp elements which is an element formed between two straight or flat portions that has an obtuse angle or an acute angle.

The valve stem can have an upper region with a hollow interior. A valve guide may be arranged around a portion of the upper region with the hollow interior. The valve stem can have a portion between the valve head and the upper region that has a flat, planar or flattened cross-sectional shape. The valve stem can have a cross-sectional shape in that portion that is smaller than a cross-sectional shape in the upper region. Preferably, the valve head does not include sharp elements which is an element formed between two straight or flat portions that has an obtuse angle or an acute angle. Also, preferably the peripheral edge section does not include any planar surface. In one embodiment, the peripheral edge section has a hemispherical shape between the upper surface of the valve head and the lower surface of the valve head when viewed in a plane that extends through a center of the valve head and through the peripheral edge section. The peripheral edge section can have a common cross-sectional shape around the entire circumference of the valve head. Additionally, or alternatively, the peripheral edge section can be curved entirely from the upper surface of the valve head to the lower surface of the valve head.

In one embodiment, the peripheral edge section contains an arcuate contact surface that extends from the upper surface of the valve head to the lower surface of the valve head and without any straight edges between the upper surface of the valve head and the lower surface of the valve head.

The valve head may be formed as a solid component of one or more materials, or separate from the valve stem and connected thereto in a manner to enclose a hollow space to provide a hollow interior, for example, by a circumferential welding seam that may be in and/or along the upper surface of the valve head. In both constructions, the lower surface of the valve head is curved uniformly downward in a direction away from the valve stem, i.e., convex, the lowest point at the center of the valve head or valve in its entirety and curving upward from this lowest point (when the valve is positioned with the valve head at the bottom).

The peripheral edge section contains an arcuate contact surface that extends from the upper surface to the lower surface of the valve head and without any straight edges between the upper and lower surfaces.

An internal combustion piston engine in accordance with the invention includes a cylinder head partly defining at least two ducts and a combustion chamber that selectively communicates with the ducts, and at least two poppet valves each movably arranged in the cylinder head between positions allowing or preventing flow between the combustion chamber and a respective one of the ducts. Each poppet valve has a stem, a valve head having a lower surface facing the combustion chamber, an upper surface including a portion adjacent the stem, and a peripheral edge section that extends from the upper surface of the valve head to the lower surface. Some valve heads include a hollow interior space.

The cylinder head has a valve seat for each poppet valve at an end of each duct adjacent the combustion chamber and that preferably has an arcuate contact surface that only partly matches the arcuate contact surface of the peripheral edge section. In this case, the valve head is movable into a position against the valve seat in which the arcuate contact surface of the peripheral edge section is in contact with the arcuate contact surface of the valve seat at an upper region proximate the upper surface of the valve head and the arcuate contact surface of the peripheral edge section is spaced apart from the arcuate contact surface of the valve seat at a lower region proximate the lower surface of the valve head. As such, the arcuate contact surface of the valve seat is exposed at the lower region proximate the lower surface of the valve head to the combustion chamber. As mentioned above, it is preferable that the valve seat does not include sharp elements which is an element formed between two straight or flat portions that has an obtuse angle in the area of the flow, and that each duct does not have sharp edges thereby providing a smooth operative flow through the ducts. Preferably, the valve seat also does not include sharp elements formed by two straight or flat portions that have an acute angle therebetween in the area of the flow.

When there are two valve seats, there may be a hump between the two valve seats which is curved outward in a direction into the combustion chamber. This hump may be configured and positioned to reduce the volume of the combustion chamber where combustion products collect thereby improving the efficiency of the engine and providing smooth gas flow by avoiding any sharp edges in the cylinder head. The properties of the valve head and valve seat described above may be repeated for each and every valve head and vale seat in the engine.

DESCRIPTION OF THE DRAWINGS

The invention, together with further advantages thereof, may best be understood by reference to the following description taken in conjunction with the accompanying drawings, wherein like reference numerals identify like elements, and wherein.

DETAILED DESCRIPTION OF THE INVENTION

The present invention relates to an improved internal combustion piston engine having a cylinder head and intake and exhaust poppet valves. The poppet valves have an arcuate edge without sharp elements on the surfaces over which air or air/fuel mixture flows during operation of the poppet valves or assembly of which they are a part.

Figure 1:
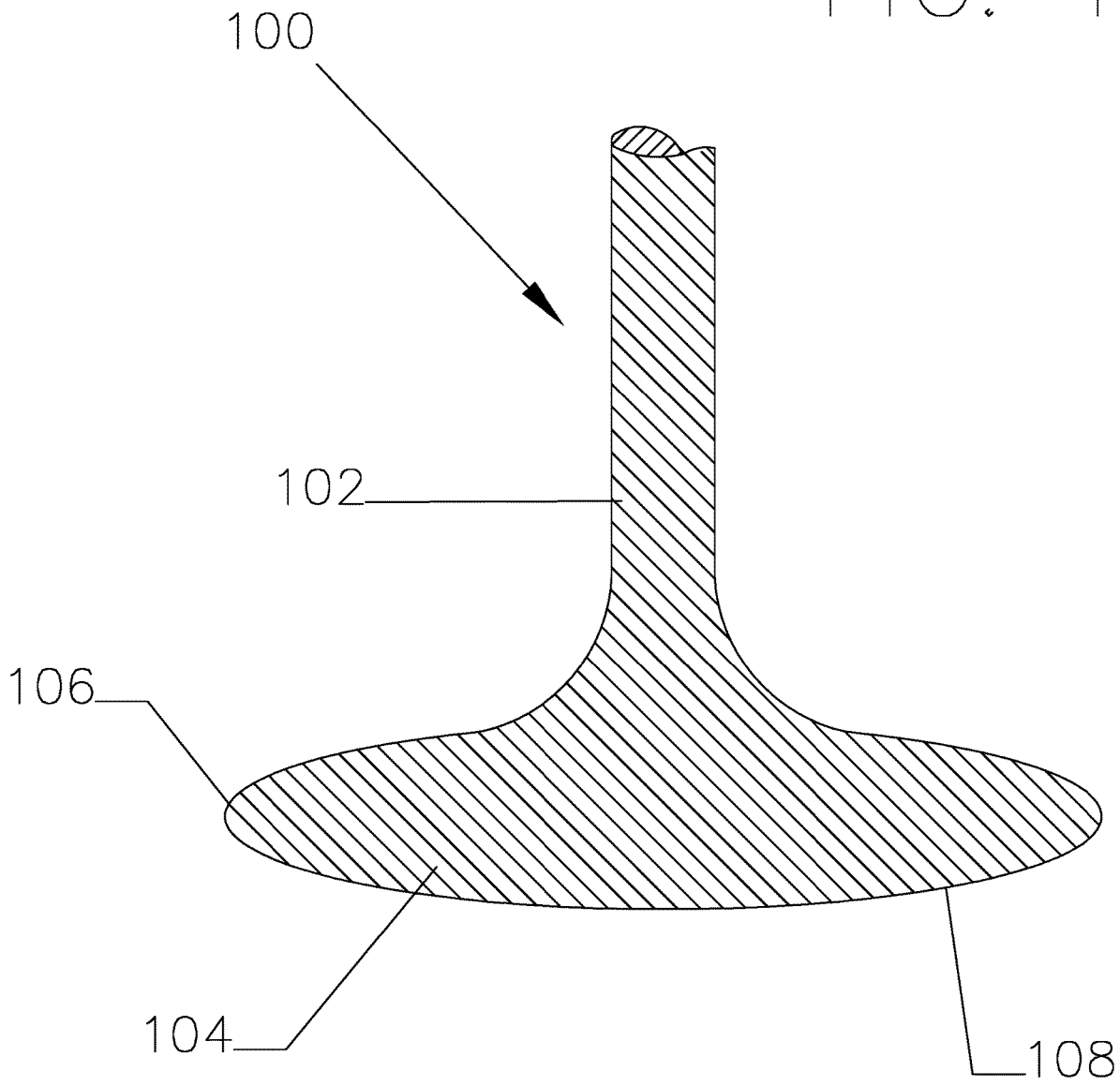
FIG. 1 is a cross-sectional view of a first embodiment of a poppet valve in accordance with the invention.

Referring to the accompanying drawings wherein like reference numbers refer to the same or similar elements, FIG. 1 shows a first embodiment of a poppet valve 100 including a valve stem 102 of the poppet valve 100 permanently attached at one end to a valve head 104 which has an arcuate edge or contact surface 106 and no sharp elements. The permanent attachment between the valve head 104 and the valve stem 102 may be the result of unitary formation of the valve stem 102 and valve head 104 or manner of attached resulting in a permanent fixation, e.g., welding.

In this embodiment, the valve head 104 is solid and may be made of a single material or substance (which might be a combination of different materials) through molding, forging, or by any other process to make solid automotive components, and specifically poppet valves. The material or materials of the poppet valve 100 in its entirety may be any known materials.

Advantages of providing a valve head without sharp elements on the upper region of the valve head, which is the area in particular in which there is gas flow, is the subject of the applicant's earlier U.S. Pat. No. 10,787,939 (U.S. patent application Ser. No. 16/539,098 incorporated by reference herein), and discussed extensively therein. These same advantages are applicable to valve head 104. Sharp elements, considered in some embodiments to be formed by two planar or flat surfaces that meet at an obtuse angle or an acute angle, are detrimental to the flow over those surfaces since the sharp element creates turbulence. The valve head may have sharp elements in portions over which there is no fluid flow as this is immaterial to the novelty of the invention of avoiding sharp elements over surfaces of the valve head subject to operative flow. This, in particular in the valve head, the peripheral edge section between the upper and lower surfaces and the lower surface of the valve head do not include sharp elements. Preferably, the portions of the upper surfaces subject to fluid flow also do not include sharp elements.

Although a permanent attachment, and preferably unitary formation, of the valve head 104 and the valve stem 102 are desired, other options are envisioned, including separate formation and then permanent attachment.

An important aspect of poppet valve 100 is that the arcuate edge 106 extends around the entire circumference of the valve head 104. As such, the arcuate edge 106 of the valve head 104 does not include sharp elements. This means that it preferably does not include any straight (flat) parts in the area over which there is air flow or air/fuel flow but is curved entirely from the upper surface of the valve head 104 to the lower surface of the valve head 104. Considering this aspect with reference to the slope, the slope of the arcuate edge 106 from the upper surface of the valve head 104 (starting at zero if the upper surface is planar and parallel to a horizontal axis) is negative, continuously increasing in magnitude (sign is still negative) until it reaches an infinite slope at the inflection point and then is positive at a maximum and continuously decreasing until it reaches the center point of the lower surface 108 of the valve head 104. By eliminating an obtuse angle between any two surface edge portions, sharp deflections of flow of gas are avoided, which reduces turbulence. Such obtuse angles are common in prior art poppet valves disclosed in the above-identified prior art patent publications.

In contrast to prior art poppet valves that have a flat, planar lower surface, the curving lower surface 108 of the valve head 104 has a curving shape coming to point or virtual point at the center of the surface 108. That is, there may be a uniformly curved surface with the same cross-section so that if a plane intersects the center of the surface 108, it will be the same regardless of where the plane intersects. As such, the lower surface 108 may be considered to be uniformly convex with the lowest point at the center and the same curvature extending form the center to all peripheral edges of the valve head 104 (since the valve head 104 is circular).

The embodiment shown in FIG. 1 and the other figures are schematic only and does not represent a limitation on the number of possible configurations. The arcuate edge may be a smooth arcuate edge having the same curvature all around the circumference of the valve stem 102. Alternatively, the arcuate edge may have different shapes at different locations along the circumference of the valve stem 102 and the valve head 104.

Details of the embodiment of the invention will vary according to the specific engine design and characteristics. Conventional engine materials and technologies used to produce existing poppet valves and cylinder heads having valve seat can be used to provide the poppet valves and corresponding valve seats in accordance with the invention.

Figure 2:
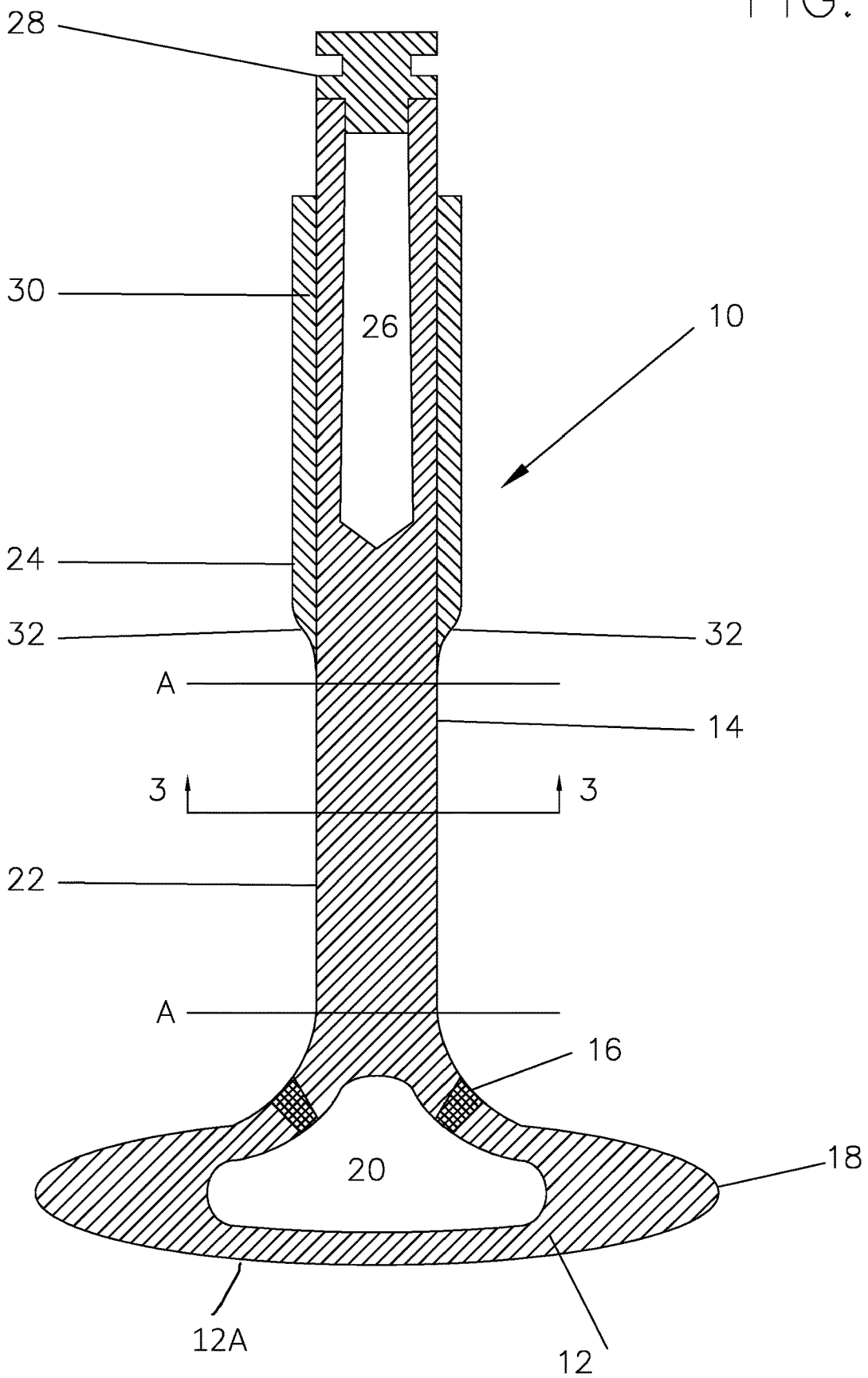
FIG. 2 is a cross-sectional view of a second embodiment of a poppet valve in accordance with the invention.

As shown in FIG. 2, a poppet valve 10 in accordance with the invention includes a hollow valve head 12 connected to a valve stem 14 by a circumferential welding seam 16. As in poppet valve 100, the valve head 12 has an arcuate edge or contact surface 18 and no sharp elements in the area of the gas flow. Thus, the same, and additional, advantages of poppet valve 100 disclosed in the '098 application may be obtained by poppet valve 10.

The arcuate edge 18 is shaped circumferentially so that as the valve head 12 expands as a result of heat, it will maintain contact with the valve seat of the combustion piston engine head in which the poppet valve 10 is situated.

The circumferential welding seam 16 is needed because the valve head 12 is entirely separate from the valve stem 14 and must be connected thereto in a manner to seal an interior hollow space 20 formed between the valve head 12 and the valve stem 14. The presence of this hollow interior space 20 serves to reduce the weight of the valve 10. A weight reduction of a valve of a combustion engine obtains advantages, such as proper valve operation, avoiding valve floating during high revolutions per minute (RPM's), and reducing valve spring power.

By reciting that the seam 16 is a circumferential welding seam, it is meant that it extends entirely about or around the valve stem 14. It may be annular, circular or cylindrical or in any other shape that forms a loop around the valve stem 14. It is formed by placing the valve stem 14 close to the valve head 12, or vice versa, and operating welding equipment with a suitable welding material to physically bond the lower edge of the valve stem 14 to an inner peripheral edge of the valve head 12. Prior to this welding, the valve stem 14 will have an exposed lower edge with a depression therein (when viewed from the bottom in the perspective of FIG. 2) while the valve head 12 with have its interior space 20 expose to the ambient atmosphere. Welding will result in closure of this interior space.

Selection of the welding material and welding conditions are within the purview of those skilled in the welding field, upon being provided with and thus knowing the desired characteristics and material properties of the poppet valve 10 herein. That is, once the material of the valve head 12 and the valve stem 14 are selected based on their operating conditions, the welding material is selected to be compatible with this material or these materials and to provide a sufficient strong and durable bond therebetween to enable functional use of the poppet valve 10. After selecting the welding material, the manner in which the welding can take place and is performed is within the purview of welders. The weld 16, and poppet valve 10 including the same, can be tested prior to installation to ensure it is compliant with desired characteristics.

The dimensions of the hollow space 20 are selected to ensure sufficient stability of the poppet valve 10 and durability. The dimensions of the hollow space 20 may also be selected in view of design considerations. One skilled in the art to which this invention pertains would be able to design a valve head 12 with a hollow space 20 to achieve the advantages of the invention disclosed herein in view of the disclosure herein and their knowledge of material science and engine characteristics.

Figure 3:
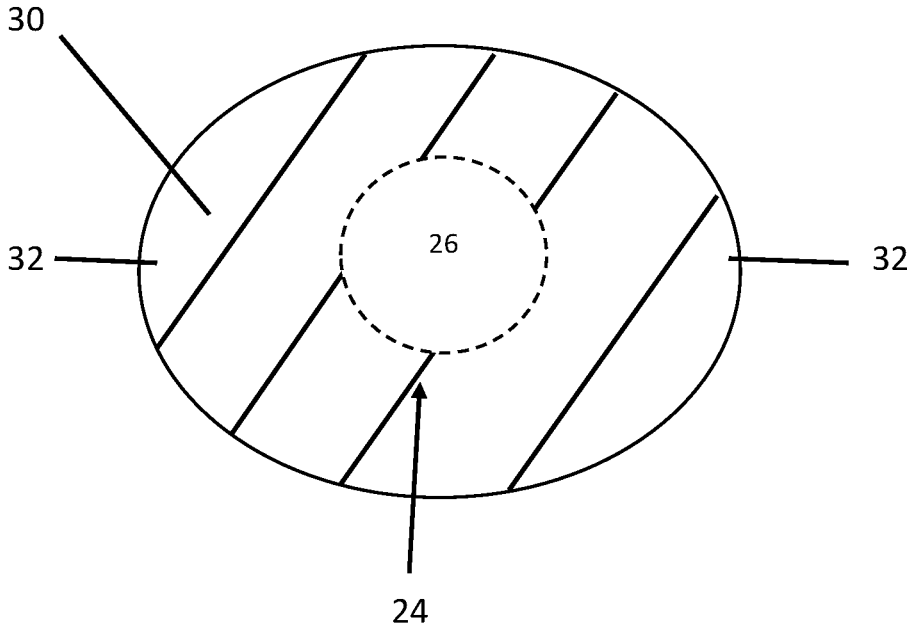
FIG. 3 is a cross-section of the valve stem of the valve in FIG. 2 taken along the line 3-3.

The welding seam 16 is positioned so that it is not in the area of the valve 10 that will come into contact with burning combustion products, i.e., the lower surface 12A of the valve head 12 and the surfaces at the circumferential edges of the valve 10. Rather, the welding seam 16 is preferably positioned adjacent to and in the area where the valve head 12 will join the valve stem 14. Lower surface 12A may have the same properties, e.g., shape, as the lower surface 108 in the poppet valve 100 shown in FIG. 1.2A The valve stem 14 then has a portion 22 wherein its cross-section is not circular but rather flattened along each side as shown in FIG. 3 in the limits roughly between the lines designated A. This also provides a reduction in the weight of the valve 10. This flattened cross-section of the valve stem 14 is thus only generally in that portion above the welding seam 16 and approximately below a valve guide 30.

Accordingly, an upper region or portion 24 of the valve stem 14 includes a hollow interior space 26 sealed by a plug 28 at an upper end, and having the valve guide 30 around a periphery of the upper portion 24. The valve guide 30 extends over only part of the upper portion 24 as shown but can extend over the entire upper portion 24. The plug 28 can be configured to engage with a valve cam (not shown) to move the valve 10 during operation and use. This portion of the valve stem 14 with the valve guide 30 has a round cross-sectional shape, i.e., is cylindrical, and when the hollow interior space 26 is itself cylindrical, then this portion of the valve stem is partly tubular. The hollow space 26 may only begin at a distance above the location where the valve guide 30 is present. The hollow space 26 can be formed in the valve stem 14 at least partly above the upper end of the valve guide 30 as shown. Alternatively, the valve guide 30 can surround the hollow space 26 in its entirety.

There are no sharp edges at the interface between the valve guide 30 and the outer peripheral surface of the valve stem 14 below the valve guide 30, i.e., in the area designated 32. In prior art valve stems, often there is a sharp edge between the valve guide and the outer surface of the valve stem, a step of sorts which provides an annular surface facing the bottom of the valve. The bottom surface is often perpendicular to the outer surface of the valve stem and also the outer surface of the valve guide. This forms two sharp corners, one between the outer surface of the valve stem below the valve guide and the bottom surface of the valve guide, and another one between the bottom surface of the valve guide and the outer surface of the valve guide. These sharp corners are often subject to the air/gas flow through the duct of the engine and detrimentally affect the flow properties, among other things, causing turbulence.

In the invention, since these sharp edges are eliminated by providing the interface between the outer surface of the valve guide and the outer surface of the valve stem below the valve guide as a curving surface, turbulence is avoided in this area, thereby improving the flow of gas through the duct.

Figure 4:
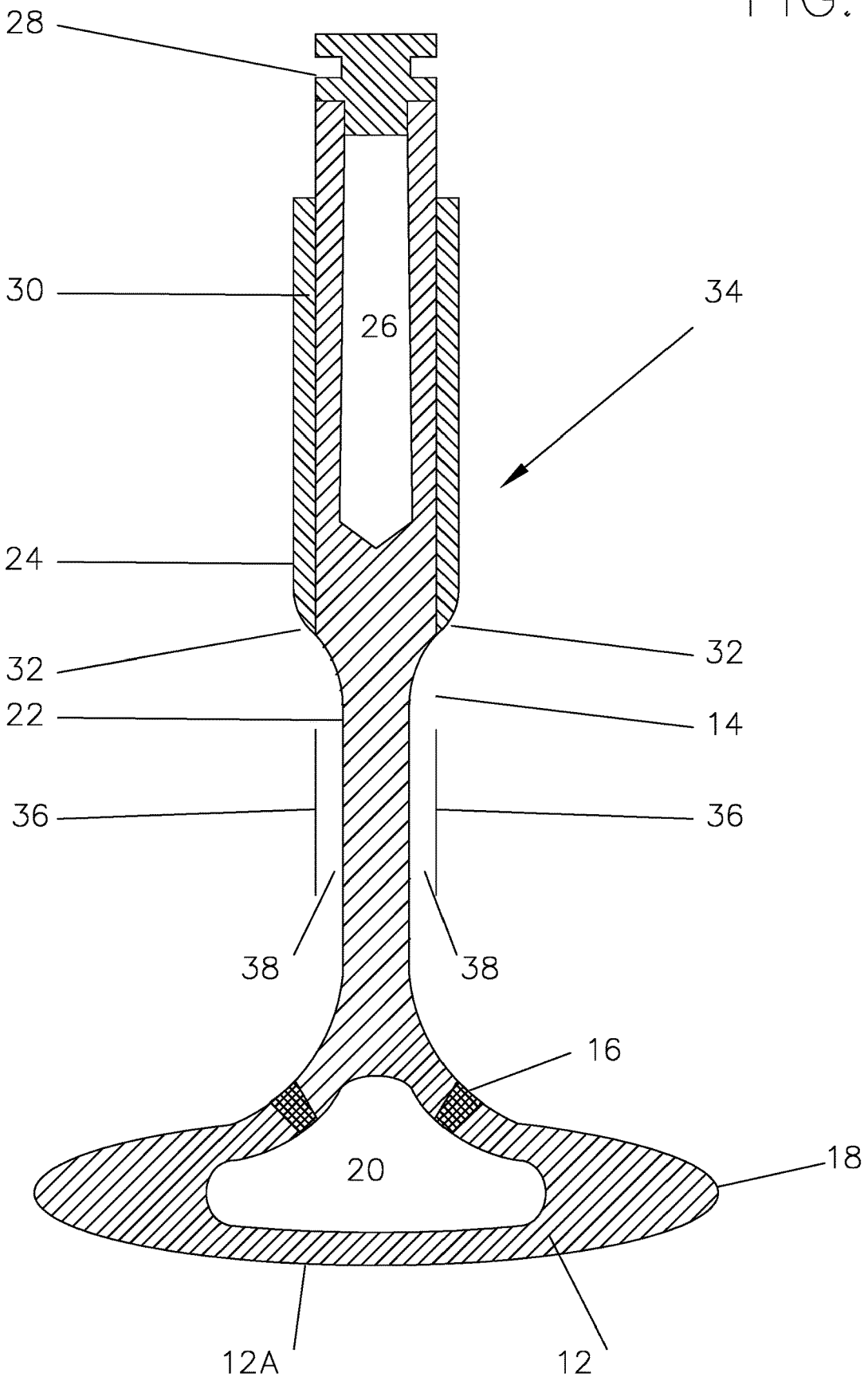
FIG. 4 is a cross-sectional view of another embodiment of a poppet valve in accordance with the invention.

FIG. 4 shows another poppet valve 34 in which a further reduction in weight is obtained by reducing the thickness of the portion 22 of the valve stem 14. The solid lines 36 show the thickness of the poppet valve of FIG. 2 and it can be seen, by the presence of the spaces 38 between the solid lines 36 and the outer surface of the portion 22 of the valve stem 14 that there is a significant reduction in the thickness which results in a weight reduction. The features of the poppet valve 34 are the same as the poppet valve 10 shown in FIG. 2.

Figure 5:
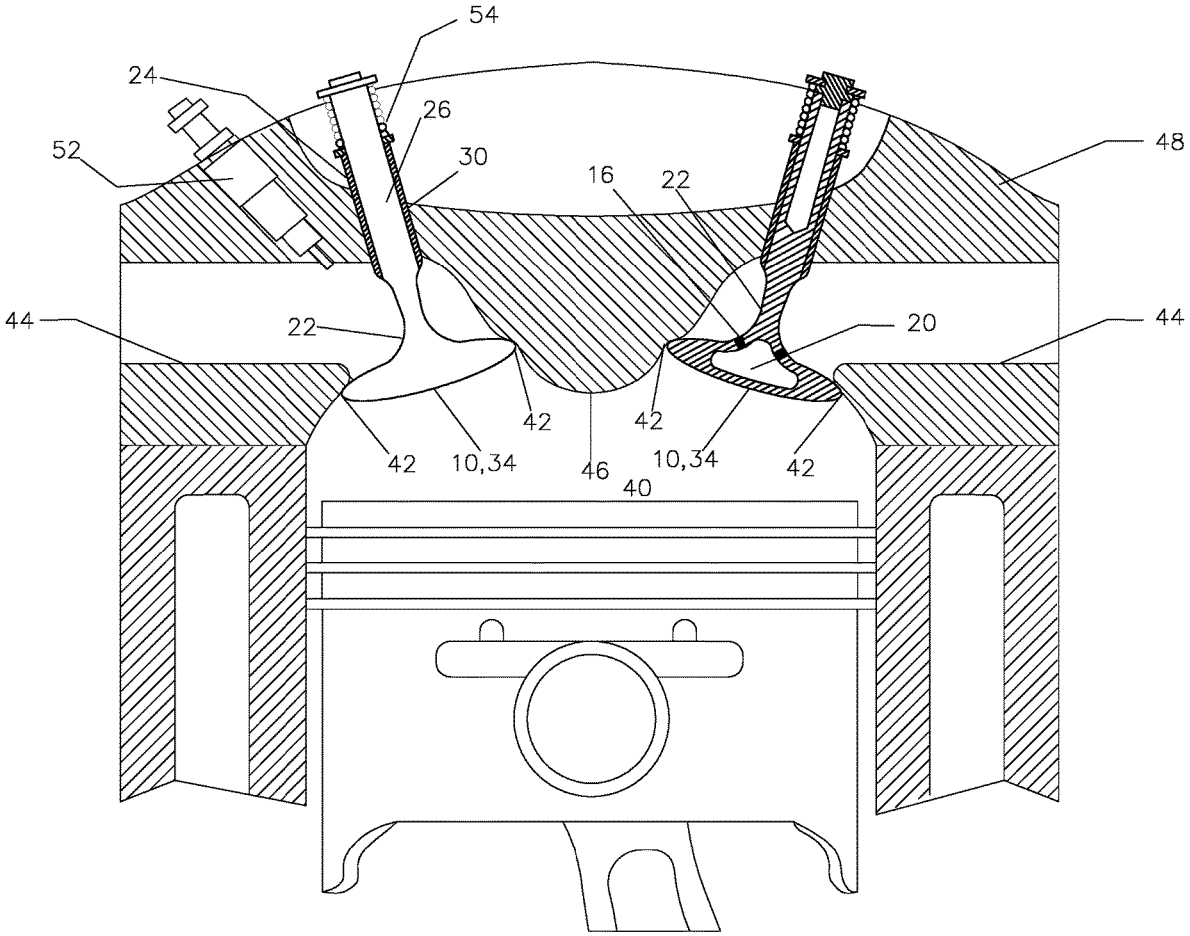
FIG. 5 is a view of a combustion system including poppet valves and an engine head in accordance with the invention.

FIG. 5 shows an arrangement including a combustion chamber 40 for an internal combustion engine having standard features such as a head cylinder and a piston defining a combustion chamber, an intake port or duct, an exhaust port or duct, a fuel supply, such as a fuel injector 52 for example, an intake valve, and an exhaust valve. The intake valve includes the valve 10 or 34 having the valve head 12 and valve stem 14 that has the seating surface 18 that seats against an intake and exhaust valve seat 42 at intake and exhaust port 44 during the opening and closing action of intake and exhaust valve 10, 34. Valve guide 30 surrounds the valve stem 14 and is dimensioned in close relationship with an outer surface of the valve stem 14 for guiding the movement of valve stem 14 during the opening and closing action of intake and exhaust valve 10, 34. The valve guide has a lower end surface that extends into the intake and exhaust port. Although the hollow space 20 is shown only in the valve 10, 34 on the right, the valve 10, 34 on the left will be the same. The manner in which the arrangement operates is well known to those skilled in the art to which this invention pertains.

The intake and exhaust ports 44 lead respectively, to a supply of combustion materials to be inlet via the intake portion 44 to the combustion chamber 40 and to remove combustion products resulting from the combustion of fuel and air in the combustion chamber. Such a supply arrangement and combustion removal are known to those skilled in the art to which this invention pertains.

At the top of the valve guide, there is a valve seal (not shown) for avoiding flow of oil into the combustion chamber, for providing lubrication of the valve stem 14 and valve guide. An upper end of valve stem 14, i.e., the plug 28, is arranged in mechanical communication with a valve cam (not shown) of the combustion engine for driving the intake and exhaust valve 10, 34 to an open position. Intake and exhaust valve 10, 34 is driven to a closed position by the action of a valve spring 54.

An important aspect of the combustion chamber 40 is that the valve seat 42 of the intake and exhaust ports 44 is curved circumferentially and does not include any sharp edges. As a result, if the valve head 12 expands as a result of heating during operation, there is still a seal between the valve seat 42 and the surface 18 of the valve 10, 34. By curving both the seating surface 18 of the valve 10, 34 and the valve seat 42, suitable sealing is provided regardless of a change in size of the valve head 12 as a result of heating during operation.

Yet another important feature is that the space between the valve seats 42 that mate with the valves 10, 34 is not flat as in prior art poppet valves, see, for example, FIG. 1 of U.S. Pat. Appln. Publ. No. 2009/0095247, incorporated by reference herein. Rather, the area between the valve seats 42 is curved outward. There is thus a hump 46 between the valve seats 42 that projects outward from the housing 48 defining the combustion chamber 40 and into the combustion chamber 40, i.e., inward beyond the location of the two valve seats 42 and the lower surfaces of the valves 10, 34. The hump 46 reduces the volume of the combustion chamber 40 where combustion products collect, improving the efficiency of the engine, and also inherently by its curvature, aids in the mating of the valves 10, 34 to the curving surfaces of the valve seats 42 and providing smooth gas flow and avoiding any sharp edges in the cylinder head. This partly attained by eliminating any sharp edges between the hump 46 and the valve seats 42. Sharp edges detrimentally affect the intake flow and combustion and exhaust reactants and eliminating sharp edges thereof improves air and gas flow and the combustion process overall as a result.

An operational cycle of combustion chamber 40 is similar to the one disclosed in U.S. Pat. Appln. Publ. No. 2009/0095247.

Disclosed above are therefore poppet valves and cylinder heads that allow for increased filling of the cylinder, distribution of the fuel-air mixture within the combustion chamber in a uniform manner, and faster and better removal of combustion products. Individually or in any combination, these advantages improve the combustion process and reduce back pressure on the piston, resulting in increased efficiency and reduced pollution. Moreover, poppet valves in accordance with the invention overcome many of the limitations of conventional poppet valves.

The foregoing description and illustrations are representative only and do not imply any limitation on the relative orientation of the engine in accordance with the invention during use. Rather, the illustrations and accompanying description are provided to explain the invention and the relationship between the components thereof. Moreover, features of the prior art references identified above may be incorporated into the application, such as those characteristics relating to the materials used in the poppet valve or its manner of formation. These modifications are considered to be part of the disclosed invention. These identified prior art references are also incorporated by reference herein in their entirety.

Finally, while particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A poppet valve for an internal combustion piston engine, comprising:

a valve stem; and a valve head having a lower surface and an upper surface opposite said lower surface and including a portion adjacent said valve stem, and a peripheral edge section that extends from said upper surface of said valve head to said lower surface of said valve head, said valve head being connected to said valve stem by a circumferential seam in or along said upper surface of said valve head such that said circumferential seam forms part of said upper surface and a hollow space is defined between said valve stem and said valve head, said peripheral edge section being curved entirely from a location of said upper surface of said valve head adjacent said valve stem to said lower surface of said valve head, and said lower surface of said valve head being curved outward in a direction away from said valve stem over its entirety, whereby said peripheral edge section and said lower surface of said valve head do not include sharp elements.

2. The poppet valve of claim 1, wherein said valve head is solid.

3. The poppet valve of claim 1, wherein said peripheral edge section does not include any planar surface.

4. The poppet valve of claim 1, wherein said peripheral edge section has a hemispherical shape between said upper surface of said valve head and said lower surface of said valve head when viewed in a plane that extends through a center of said valve head and through said peripheral edge section.

5. The poppet valve of claim 1, wherein said peripheral edge section has a common cross-sectional shape around the entire circumference of said valve head.

6. The poppet valve of claim 1, wherein said lower surface is uniformly convex.

7. The poppet valve of claim 1, wherein said peripheral edge section contains an arcuate contact surface that extends from said upper surface of said valve head to said lower surface of said valve head and without any straight edges between said upper surface of said valve head and said lower surface of said valve head.

8. The poppet valve of claim 1, wherein said valve stem has a lower region adjacent said valve head that has a solid portion and an upper region with a hollow interior, further comprising a plug that engages with said valve stem and closes the hollow interior of said upper region, further comprising a valve guide arranged around a portion of said upper region with the hollow interior, an interface between said valve guide and an outer peripheral surface of said valve stem below said valve guide lacking sharp edges.

9. The poppet valve of claim 1, wherein said valve stem has a lower region adjacent said valve head that has a solid portion and an upper region with a hollow interior, further comprising a plug that engages with said valve stem and closes the hollow interior of said upper region, said valve stem having a portion between said valve head and said upper region that has a flattened cross-sectional shape.

10. A poppet valve for an internal combustion piston engine, comprising:

a valve stem; and a valve head having a lower surface and an upper surface opposite said lower surface and including a portion adjacent said valve stem, and a peripheral edge section that extends from said upper surface of said valve head to said lower surface of said valve head, said peripheral edge section being curved entirely from a location of said upper surface of said valve head adjacent said valve stem to said lower surface of said valve head, and said lower surface of said valve head being curved outward in a direction away from said valve stem over its entirety, wherein said valve stem has a lower region adjacent said valve head that has a solid portion and an upper region with a hollow interior, the poppet valve further comprising a plug that engages with said valve stem and closes the hollow interior of said upper region, whereby said peripheral edge section and said lower surface of said valve head do not include sharp elements.

11. The poppet valve of claim 10, wherein said valve head has a hollow interior.

12. The poppet valve of claim 11, wherein said valve head is separate from said valve stem and connected to said valve stem in a manner to enclose a hollow space to provide the hollow interior.

13. The poppet valve of claim 12, wherein said valve head is connected to said valve stem by a circumferential seam in or along said upper surface such that said seam forms part of said upper surface.

14. The poppet valve of claim 10, further comprising a valve guide arranged around a portion of said upper region with the hollow interior, an interface between said valve guide and an outer peripheral surface of said valve stem below said valve guide lacking sharp edges.

15. The poppet valve of claim 10, wherein said valve stem has a portion between said valve head and said upper region that has a flattened cross-sectional shape.

16. The poppet valve of claim 10, wherein said valve stem has a cross-sectional shape in said portion between said valve head and said upper region that is smaller than a cross-sectional shape in said upper region with the hollow interior.

17. An internal combustion piston engine head, comprising:

a cylinder head partly defining at least two ducts and a combustion chamber that selectively communicates with said at least two ducts; and two poppet valves, each of said poppet valves comprising:

a valve stem; and a valve head having a lower surface and an upper surface opposite said lower surface and including a portion adjacent said valve stem, and a peripheral edge section that extends from said upper surface of said valve head to said lower surface of said valve head, said peripheral edge section being curved entirely from a location of said upper surface of said valve head adjacent said valve stem to said lower surface of said valve head, and said lower surface of said valve head being curved outward in a direction away from said valve stem over its entirety, whereby said peripheral edge section and said lower surface of said valve head do not include sharp elements, a first one of said poppet valves being movably arranged in said cylinder head between a position allowing flow between said combustion chamber and a first one of said at least two ducts and a position preventing flow between said combustion chamber and said first one of said at least two ducts, and a second one of said poppet valves being movably arranged in said cylinder head between a position allowing flow between said combustion chamber and a second one of said at least two ducts and a position preventing flow between said combustion chamber and said second one of said at least two ducts, said cylinder head having a valve seat at an end of each of said at least two ducts adjacent said combustion chamber and an arcuate contact surface that only partly matches said arcuate contact surface of said peripheral edge section of the respective one of said poppet valves, for each of said poppet valves, said valve head being movable into a position against the respective one of said two valve seats in which said arcuate contact surface of said peripheral edge section is in contact with said arcuate contact surface of the respective one of said two valve seats at an upper region proximate said upper surface of said valve head and said arcuate contact surface of said peripheral edge section is spaced apart from said arcuate contact surface of the respective one of said two valve seats at a lower region proximate said lower surface of said valve head, said arcuate contact surface of each of said two valve seats being exposed at the lower region proximate said lower surface of said respective valve head to said combustion chamber, the engine head further comprising a hump between said two valve seats, said hump being curved outward in a direction into said combustion chamber and extending inward into said combustion chamber beyond said two valve seats and beyond lower surfaces of said first and second poppet valves when said poppet valves are in the closed position.

18. The engine head of claim 17, wherein each of said at least two ducts does not have sharp edges thereby providing a smooth operative flow through said at least two ducts.

19. The engine head of claim 17, wherein by extending inward into said combustion chamber beyond said two valve seats and beyond lower surfaces of said first and second poppet valves when said poppet valves are in the closed position, said hump reduces the volume of said combustion chamber where combustion products collect thereby improving the efficiency of the engine and providing smooth gas flow by avoiding any sharp edges in the cylinder head.

20. The engine head of claim 17, wherein each of said two valve seats does not include sharp elements.

* * * * *